US007632091B2

(12) United States Patent
Steinbach et al.

(10) Patent No.: US 7,632,091 B2
(45) Date of Patent: Dec. 15, 2009

(54) PREMIX BURNER FOR OPERATING A COMBUSTION CHAMBER

(75) Inventors: Christian Steinbach, Birmenstorf (CH); Martin Andrea Von Planta, Oetwil (CH); Thomas Ruck, Rekingen (CH); Weiqun Geng, Daettwil (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/850,849

(22) Filed: Sep. 6, 2007

(65) Prior Publication Data

US 2008/0070176 A1 Mar. 20, 2008

Related U.S. Application Data

(63) Continuation of application No. PCT/EP2006/060437, filed on Mar. 3, 2006.

(30) Foreign Application Priority Data

Mar. 9, 2005 (CH) ..... 0409/05

(51) Int. Cl.
*F23D 14/46* (2006.01)

(52) U.S. Cl. ..... 431/350; 431/8; 431/352; 431/354; 431/353; 60/800; 60/737; 60/743

(58) Field of Classification Search ..... 431/354, 431/350, 352, 173, 187, 8, 284, 178, 285, 431/174, 7, 202, 268, 33, 115, 116; 239/403, 239/397.5, 431, 568; 60/800, 737, 743, 738, 60/742

See application file for complete search history.

(56) References Cited

U.S. PATENT DOCUMENTS 3,217,781 A * 11/1965 Curtis et al. ..... 239/404

(Continued)

FOREIGN PATENT DOCUMENTS

DE 4223828 12/1993

(Continued)

OTHER PUBLICATIONS

Search Report for Swiss Patent App. No. 0409/2005 (Jun. 28, 2005).
International Search Report for PCT Patent App. No. PCT/EP2006/060437 (Jun. 22, 2006).
International Preliminary Report on Patentability for PCT Patent App. No. PCT/EP2006/060437 (Jul. 4, 2007).

*Primary Examiner*—Steven B McAllister
*Assistant Examiner*—Avinash Savani
(74) *Attorney, Agent, or Firm*—Cermak Kenealy Vaidya & Nakajima LLP; Adam J. Cermak

(57) ABSTRACT

A premix burner for producing an ignitable fuel/air mixture has a swirl generator with at least two burner shells (B) which complement one another to form a throughflow body, which in each case have a first burner shell section (1) with a partial cone shape and together enclose an axially conically widening swirl space and which mutually define, in the axial cone longitudinal direction, tangential air inlet slots (LS), through which the combustion feed air (L) passes into the swirl space, in which an axially spreading swirl flow forms, and includes fuel feeds which are arranged at least in sections along the tangentially running air inlet slots (LS). A second burner shell section (8) curved in opposition to the first burner shell section (1), in each case designed in a partial cone shape, is added flush to the first burner shell section (1), a third burner shell section (9) adjoins the second burner shell section (8) flush, the third burner shell section (9) having a curvature tangentially adapted to the second burner shell section (8), and the third burner shell section (9) defines, on the one side in each case, one of the tangential air inlet slots (LS) and provides a leading edge (12) serving for the combustion feed air (L).

11 Claims, 3 Drawing Sheets

U.S. PATENT DOCUMENTS

| | | | | | |
|---|---|---|---|---|---|
| 4,136,565 | A | * | 1/1979 | Migrin et al. | 73/861.62 |
| 4,781,030 | A | * | 11/1988 | Hellat et al. | 60/743 |
| 5,085,575 | A | | 2/1992 | Keller et al. | |
| 5,161,946 | A | * | 11/1992 | Bortz et al. | 415/183 |
| 5,479,773 | A | | 1/1996 | McCoomb et al. | |
| 5,738,509 | A | | 4/1998 | Marling et al. | |
| 5,984,670 | A | * | 11/1999 | McMillan et al. | 431/350 |
| 6,155,820 | A | * | 12/2000 | Dobbeling et al. | 431/350 |
| 6,702,574 | B1 | | 3/2004 | Doebbeling | |

FOREIGN PATENT DOCUMENTS

| | | |
|---|---|---|
| DE | 4412315 | 10/1995 |
| EP | 0210462 | 2/1987 |
| EP | 0321809 | 6/1989 |
| WO | WO2005/078348 | 8/2005 |
| WO | WO2006/094939 | 9/2006 |

* cited by examiner

PREMIX BURNER FOR OPERATING A COMBUSTION CHAMBER

This application is a Continuation of, and claims priority under 35 U.S.C. § 120 to, International application number PCT/EP2006/060437, filed 3 Mar. 2006, and claims priority therethrough under 35 U.S.C. § 119 to Swiss application number 00409/05, filed 9 Mar. 2005, the entireties of which are incorporated by reference herein.

BACKGROUND

1. Field of Endeavor

The invention relates to a premix burner for producing an ignitable fuel/air mixture, including a swirl generator which provides at least two burner shells which complement one another to form a throughflow body, which in each case have a first burner shell section designed in a partial cone shape and together enclose an axially conically widening swirl space and which mutually define in the axial cone longitudinal extension tangential air inlet slots, through which the combustion feed air passes into the swirl space, in which an axially spreading swirl flow forms, and comprising a device for spraying fuel arranged at least in sections along the tangentially running air inlet slots.

2. Brief Description of the Related Art

Premix burners of the abovementioned generic type are known from a large number of publications, for example, from EP 0 210 462 A1 and EP 0 321 809 B1, to mention only a few. Premix burners of this type are based on the general operating principle of generating a swirl flow consisting of an air/fuel mixture inside a usually conically designed swirl generator which provides at least two partial cone shells assembled with a correspondingly mutual overlap, and this swirl flow is ignited inside a combustion chamber following the premix burner in the direction of flow, with a premix flame being formed which is spatially as stable as possible. In this case, the spatial position of the premix flame is determined by the aerodynamic behavior of the swirl flow, the swirl coefficient of which increases with increasing spread along the burner axis and thus becomes unstable and ultimately breaks down into an annular swirl flow due to a discontinuous transition between burner and combustion chamber, with a backflow zone being formed, in whose front region in the direction of flow a premix flame forms.

Of particular importance is the aerodynamic stability of the forming backflow zone, which, however, depends in a most sensitive manner on the design, shape and size of the swirl generator. For example, if it is not possible to spatially stabilize that part of the forming backflow zone which is right at the front in the direction of flow, thermoacoustic vibrations or pulsations occur to an intensified degree within the combustion system and considerably impair the entire combustion and the emission of heat.

In view of these facts, the hitherto known premix burners in use are restricted to sizes whose maximum burner diameter at the burner outlet is only 180 mm. In addition, such premix burners have a relatively acute, i.e., small, cone angle less than or equal to 18°, so that the burner length in relation to the downstream burner diameter is rather on the large side but can still be readily manipulated for fitting or maintenance purposes.

However, if it is necessary to fire combustion chambers of large dimensions, "multiple burner arrangements" which provide for the use of the above premix burners have been used hitherto. Such multiple burner arrangements of complex construction have been disclosed, for example, by DE 42 23 828 A1 or DE 44 12 315 A1. However, it is desired to reduce the complexity and thus also the number of the individual premix burners, required for firing combustion chambers of large dimensions, without at the same time having to tolerate quality losses in the combustion process itself. In addition, for reasons of environmental standards, which are always becoming stricter, with regard to the reduction of emission figures, it is necessary for the individual diffusion burners used hitherto, which are mainly used for firing silo-type combustion chambers of large dimensions, to be replaced by modern burner systems which are more environmentally compatible. In particular with regard to the avoidance of high conversion and new-procurement costs, it is desirable to provide premix burners of the largest possible dimensions in order to be able to continue to maintain, for example, the operation of such silo-type combustion chambers of large dimensions with only a single premix burner.

Theoretical considerations and tests have shown that simple scaling, for example, of a double cone burner known from EP 0 321 809 B1, is not successful, especially since, as already mentioned above, the burner length would increase disproportionately. There is also the fact that the width of the air inlet slots which run tangentially in the burner axis and through which the combustion feed air for generating the desired swirl flow flows into the swirl generator would likewise increase proportionally, so that good intermixing of fuel and combustion air can no longer be ensured to a sufficient quality.

In most premix burners in use, the partial cone shells which are provided for deflecting and guiding the feed air into the swirl generator and which may also be referred to as burner shells are designed as thin-walled baffle plates which have the shape of the lateral surface of cone halves or smaller cone segments and radially define the swirl space, the burner shells, due to their spatial arrangement, in each case jointly enclosing air inlet slots mutually oriented tangentially to the burner axis.

In endeavors to improve the absorption and output capacity of such premix burners, swirl generators having more than two burner shells are known, "multi-shell premix burners", which can also ensure a larger burner diameter. However, it has been found that no satisfactory intermixing results are obtained with such multi-shell arrangements, especially since aerodynamic problems occur which in all probability can be attributed to backflow zones forming locally in the region of the individual burner shells. This leads firstly to efficiency losses, but also entails risks if combustible fuel can collect in such backflow zones and ultimately ignite.

U.S. Pat. No. 6,702,574 B1 discloses a burner for operating a heat generator, including a swirl generator whose inlet cross section oriented in the direction of flow is of rectangular design and provides downstream, for reasons of improved intermixing, a throughflow cross section which is square or round in the direction of flow and preferably adjoining which is a mixing section of round cross section. Shown in a perspective view in the exemplary embodiment according to FIG. 3 thereof is a swirl generator whose swirl space is radially defined by burner shells 156 of curved design. The burner shell or swirl blade 156 shown in cross section has three burner shell sections which are connected to one another in one piece, a second burner shell section curved in opposition to the first burner shell section, in each case designed in a partial cone shape being added in a flush manner to the first burner shell section, and a third burner shell section adjoining the second burner shell section in a flush manner, the third burner shell section having a curvature tangentially adapted to the second burner shell section.

SUMMARY

One of numerous aspects of the present invention includes developing a premix burner in such a way that, despite an increase in the burner dimensions, the burner properties optimized in hitherto known premix burners are to be retained virtually unchanged. It is thus necessary to solve the aerodynamic problems occurring in premix burners with multi-shell arrangements and to remove the disadvantages and risks associated therewith. In particular, it is necessary to take measures to ensure that no flashback phenomena caused by gas collecting in backflow zones occur.

Features advantageously developing principals of the present invention can be gathered from the description, in particular with reference to the exemplary embodiments.

In principle, the burner shells radially defining the swirl space, which are described solely by a partial cone shape, are aerodynamically designed in such a way that feed air flow flowing through air inlet slots into the swirl space is directed largely free of losses, i.e., without any marginal vortex formation, between two burner shells defining the air inlet slot. Due to the burner shell geometry which is designed in a conventional manner as thin deflecting baffles redirecting the feed air flow, a feed air flow flowing through the air inlet slots, along a surface, facing the feed air flow, of the burner shell, is first of all accelerated continuously when entering the air inlet slot and is successively deflected until the air flow leaves the burner shell toward the swirl space. The burner shell geometry therefore has differently shaped surface regions which laterally define the air inlet slot and by which the air flow flowing radially into the air inlet slot is deflected largely without resistance, and without the formation of a marginal flow vortex close to the surface, into the swirl space for forming a swirl flow spreading axially relative to the burner. In this way, any backflow zones forming in hitherto known premix burners having multi-shell arrangements can be avoided, in which backflow zones gas accumulations are also able to form, which by spontaneous deflagration may lead to damage to the premix burner structure and in particular to the burner shells.

Thus, an exemplary burner shell designed in each case according to principles of the present invention has three differently shaped burner shell sections which are connected to one another in one piece, a second burner shell section curved in opposition to the first burner shell section in each case designed in a partial cone shape being added in a flush manner to said first burner shell section, and a third burner shell section adjoining the second burner shell section in a flush manner, said third burner shell section having a curvature tangentially adapted to the second burner shell section. Here, the third burner shell section defines on the one side in each case one of the tangential air inlet slots and provides a leading edge serving for the combustion feed air. In this case, the curvature, determined by the partial cone shape of the first burner shell section designed in a partial cone shape, merges continuously, i.e., smoothly, into the curvature of the second burner shell section, and all the locations of a change of curvature describe a line, the "turning point line", along which means for the fuel feed are provided.

A burner shell of such a design can preferably be produced by a casting process or by a forming or material-removal process. To simplify the description below, reference is made to the description of an exemplary embodiment with reference to the following figures.

BRIEF DESCRIPTION OF THE DRAWINGS

Without restricting the general idea of the invention, the invention is described by way of example below with reference to exemplary embodiments and the drawing, in which.

DETAILED DESCRIPTION OF EXEMPLARY EMBODIMENTS

Figure 1:
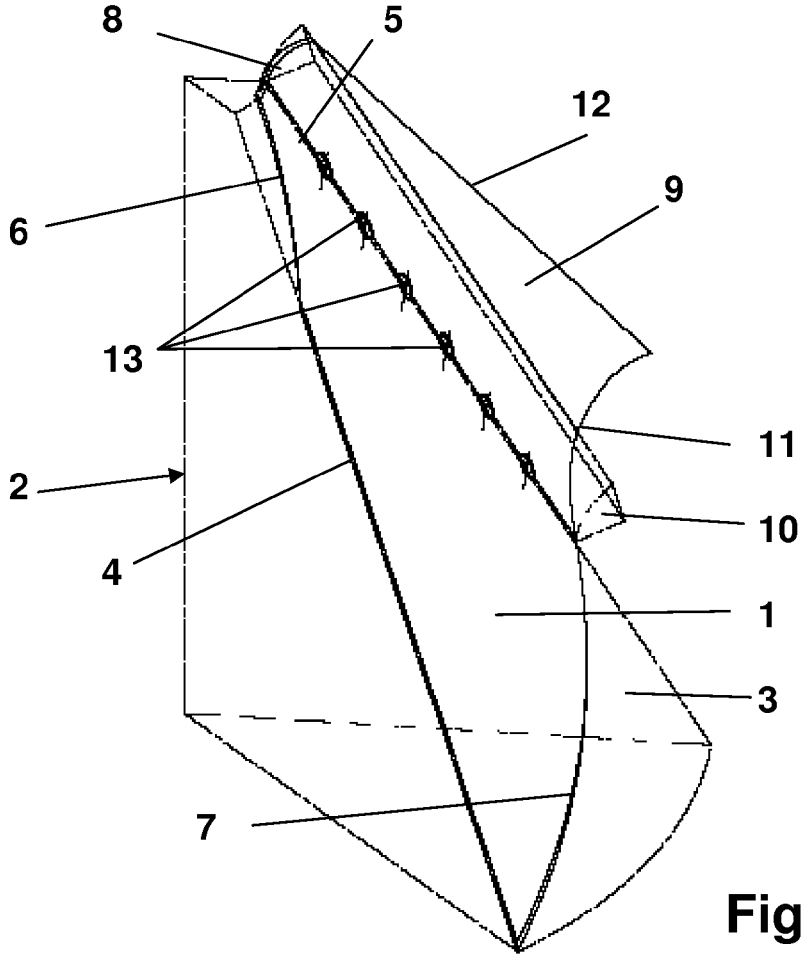
FIG. 1 shows a schematic perspective illustration of a burner shell formed according to the present invention.

Schematically shown in FIG. 1 is an exemplary burner shell designed according to principals of the present invention, having a first burner shell section 1 which can be described by the lateral surface shape of a partial cone. Shown as an auxiliary construction in order to make it easier to illustrate the geometrical design of the first burner shell section 1 is a partial segment 2 of a cone body, along the conical lateral surface 3 of which the first burner shell section 1 bears in a conforming manner. It may be noted at this point that the first burner shell section 1 corresponds to the shape of any burner shells used hitherto, the side edge 4 which is longer in the exemplary embodiment according to FIG. 1 corresponding to the trailing edge of the burner shell, and the front edge, indicated by the continuous line 5, of the burner shell section 1 corresponding to the leading edge of a hitherto conventional burner shell. As can be seen below with reference to the three-dimensional illustration of a swirl generator in FIG. 5, the burner shell shown in FIG. 1, for the purpose of fastening it to corresponding premix burner components, is fastened along its top side edge 6 of curved design and its bottom side edge 7.

In a development according to principles of the invention of the burner shell used hitherto having the shape predetermined by the first burner shell section 1, the burner shell has two further burner shell sections 8, 9 which merge smoothly and in one piece into the linear end region, indicated by the continuous line 5, of the first burner shell section 1 designed in a partial cone shape. The second burner shell section 8 directly adjoining the first burner shell section 1 has a curvature which is oriented in opposition to the curvature of the first burner shell section 1 of partial cone shape. It can be seen from the graphic illustration of the exemplary embodiment according to FIG. 1 that the first burner shell section 1 is curved convexly and the second and third burner shell sections 8, 9 are curved concavely relative to the drawing plane. In this case, the second burner shell section has the curvature of a quarter ellipse. Depicted in FIG. 1 in order to illustrate the concave curvature of the second burner shell section 8 is a prismatic body 10 whose surface facing the second burner shell section 8 corresponds to a quarter ellipse. It may be pointed out once again only as a matter of form that both the partial segment body 2 and the body 10 of prismatic design only constitute auxiliary bodies which serve to better illustrate the geometrical shape of the burner shell.

As an alternative to the shaping shown in FIG. 1 of the second burner shell section 8 like a quarter ellipse, it is also conceivable to modify the curvature and shape of the second burner shell section, for example in accordance with a quarter circle segment or a similar curved shape imitating the quarter ellipse or the quarter circle.

Furthermore, the third burner section adjoins the virtually running boundary line 11 of the second burner shell section 8 in a flush manner, this third burner section providing a curvature tangentially adapted to the second burner section. The third burner shell section 9 has a basic shape of essentially triangular design, with a front boundary edge 12, which at the same time also serves as leading edge of the burner shell designed according to the solution.

The burner shell shown in FIG. 1 is therefore essentially a combination of a pure burner shell section designed in a cone shape, a curved surface body having a surface shape of a quarter ellipse, and an extension tangential thereto which is represented by the third burner shell section 9.

Since the curvature behavior of the first burner section is oriented in opposition to that of the respective second and third burner shell sections, the curvature behavior of the burner shell surface changes continuously, i.e., smoothly, along the line 5 running virtually through the burner shell of complex form, so that all of the locations arranged along the line 5 in each case constitute turning points and the continuous line 5 can therefore be understood as a turning point line.

Figure 2:
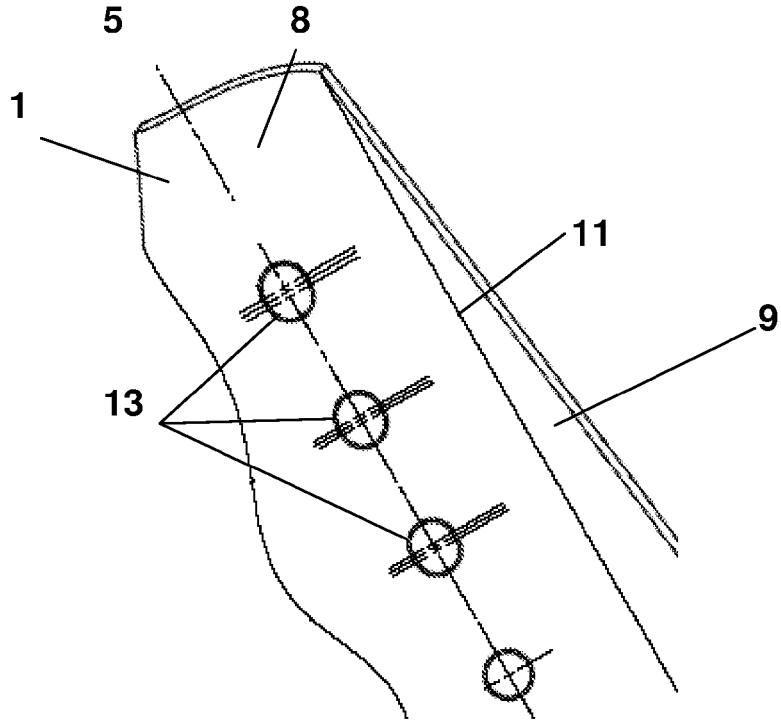
FIG. 2 shows a detailed illustration of a section of the burner shell region in the shape of a quarter ellipse with adjoining tangentially widened burner shell region of triangular design.

The burner shell shown in FIG. 1, which in addition is made of a heat-resistant flat material and preferably has a largely constant thickness along its entire surface extent, radially encloses part of the conically extending swirl space of a premix burner. The surface facing the viewer of the burner shell shown in FIG. 1 therefore faces away from the swirl space. It is therefore necessary to provide a fuel line (not shown in FIG. 1) on precisely this surface facing away from the swirl space, this fuel line serving to feed fuel through the through-openings 13 provided in each case along the turning point line 5. A detailed illustration in this respect of the through-openings 13 arranged at a distance apart along the turning point line 5 is shown in FIG. 2, which shows a top part of the burner shell designed according to the solution.

The curvature behavior of the respective burner shell sections 1, 8, and 9 can be deduced from the curvature course of the topmost side edge of the burner shell. The change of the concave curvature of the first burner shell section 1 to the convexly designed curvature of the second burner section 8 and of the third burner shell section 9 adjoining the latter with the same curvature is effected along the continuous line 5, which, as mentioned above, is to be understood as a turning point line. The third burner shell section 9 adjoins the second burner section 8 at the top end of the burner shell at an acute angle and essentially widens the curvature of the second burner shell section 8 at the location of the transition line 11 in tangential extension. The openings 13 passing through the burner shell can likewise be seen from the detailed illustration in FIG. 2, these openings 13 being arranged along the turning point line 5 and the gaseous fuel being sprayed through them.

Figure 3:
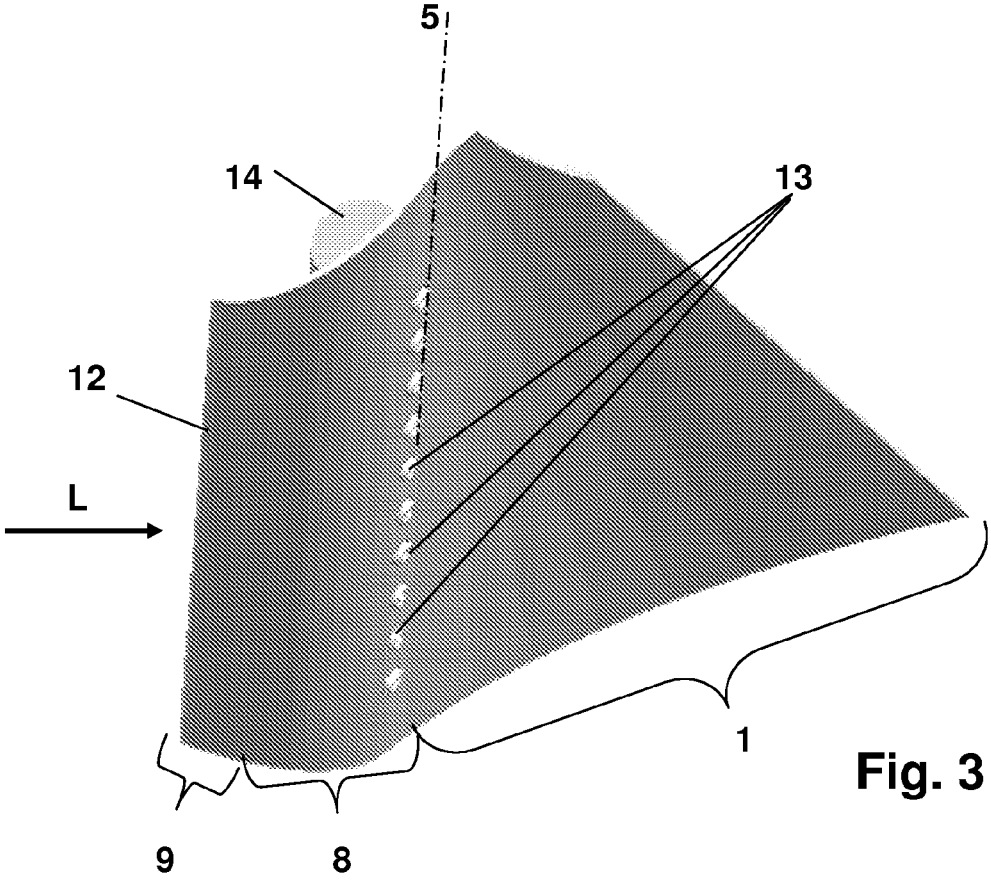
FIG. 3 shows a 3D illustration of an exemplary burner shell.
Figure 4:
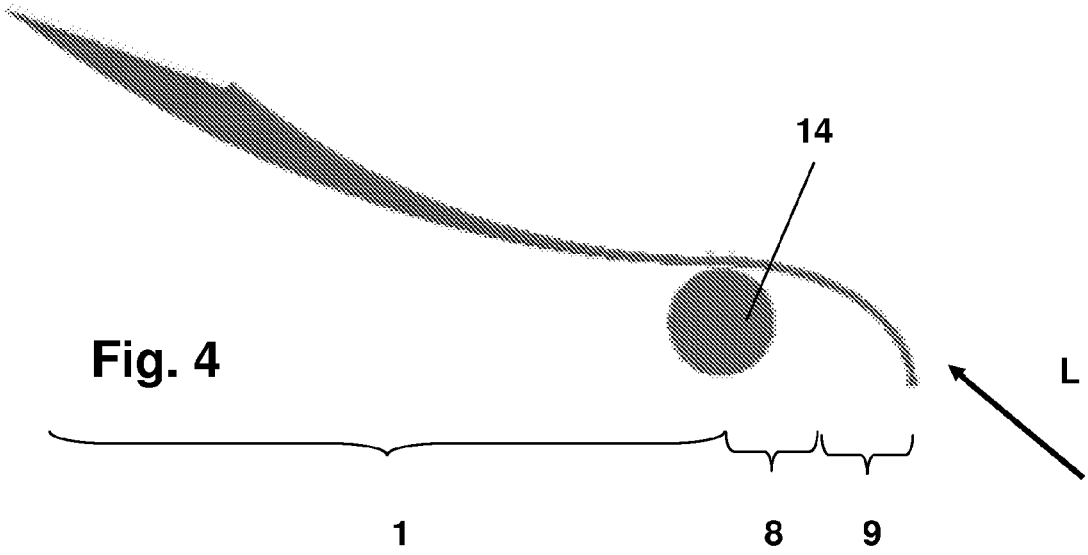
FIG. 4 shows an illustration of an exemplary burner shell in extension along the burner axis.

A three-dimensional view of a burner shell described above is shown in FIG. 3 from an angle of view which shows that surface of the burner shell which faces the swirl space. The openings 13 can clearly be seen along the turning point line 5, projecting through which openings 13 are fuel nozzles which are connected to a fuel line 14, which is attached to the burner shell in a position facing away from the swirl space. An illustration showing the burner shell in plan view can be seen from FIG. 4, to which reference is made below together with FIG. 3.

An air flow L shown symbolically by the flow arrow and radially striking the leading edge 12 of the burner shell is accelerated in the flow direction in the region of the third and the second burner section 9, 8 and furthermore is successively deflected by the first burner shell section 1 designed in a partial cone shape until the flow L leaves the burner shell via the burner shell section 1 toward the burner space or swirl space. At the region of the greatest flow velocity, which appears at the region of the turning point line 5, gaseous fuel is added to the air flow L through the openings 13, as a result of which effective intermixing of fuel and air is already obtained in this flow region.

The burner shell geometry according to the invention therefore avoids any backflow zones within the air flow along that surface of the burner shell which faces the air flow L.

In addition, the burner shell geometry is designed in such a way that it is possible to produce the burner shells without special tools, for example without special press forming tools. The shell geometry can thus always be described by a system of straight lines which are oriented axially or in the longitudinal extent of the burner shell, as a result of which the burner shell can be produced by means of a CNC bending machine.

Figure 5:
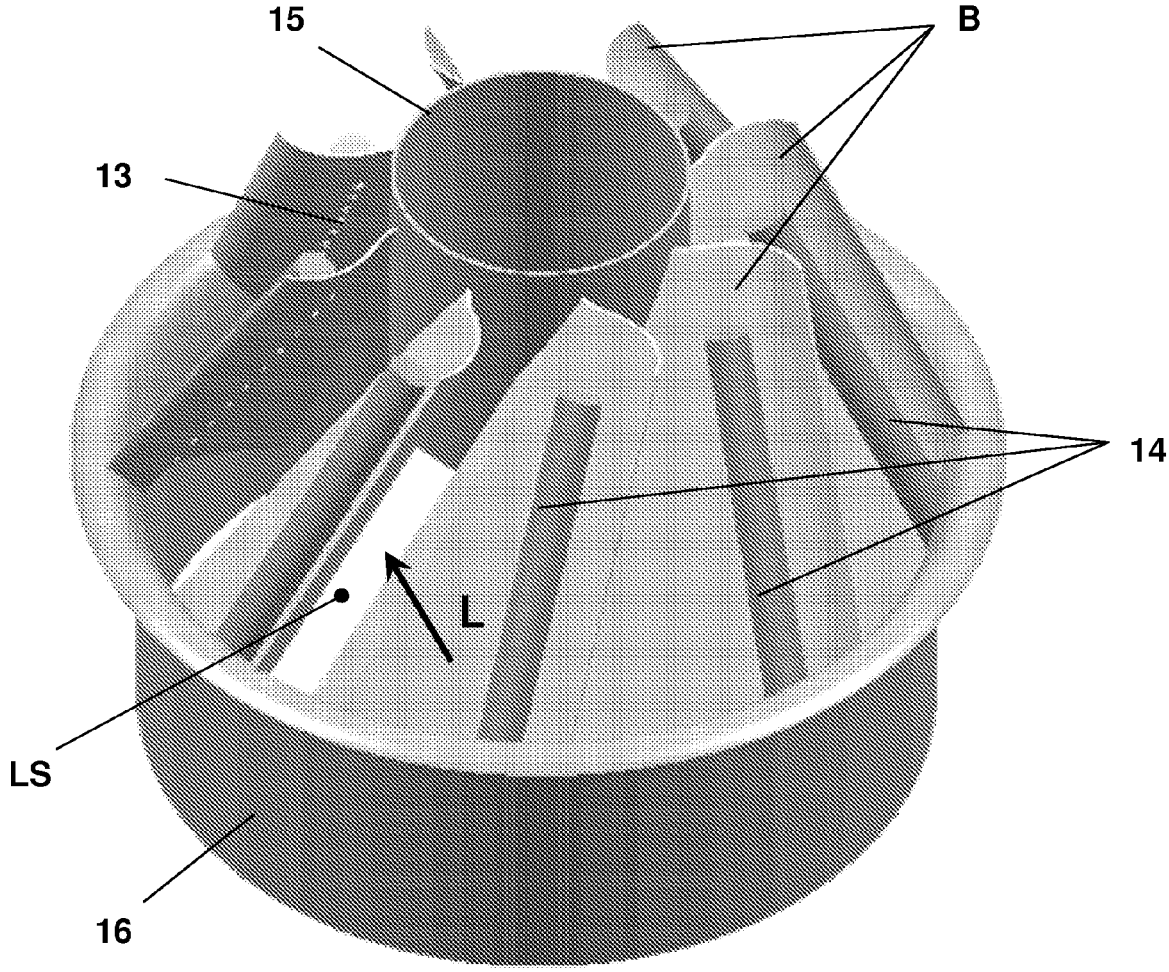
FIG. 5 shows a 3D illustration of a swirl generator with multi-shell arrangement.

Shown in FIG. 5 in three-dimensional form is a premix burner which provides eight burner shells B which radially define an inner swirl space and are shaped individually in the manner described above. In each case two burner shells B arranged adjacent to one another enclose an air inlet slot LS, through which an air flow can penetrate into the swirl space. It is clear that the absorption capacity of the premix burner, due to the provision of eight individual air inlet slots LS, is very much greater than in the case of "double cone burners", in which only two partial cone shells define the swirl space. On the one side, the individual burner shells B, with their top boundary edge, are firmly connected to a centrally arranged retaining structure 15 of cylindrical design, through which means can be inserted in the axial direction for the axial fuel feed. On the other side, the burner shells B are connected along their bottom boundary edge to a shaped element 16, through which the swirl flow forming inside the swirl generator is transferred into a mixing tube (not shown in any more detail) or directly into a combustion chamber (not shown in any more detail) for further intermixing or ignition, respectively. Through the fuel lines 14 arranged in a concealed manner on the burner shells in the direction of flow through the respective second and third burner shell sections, gaseous fuel is fed into the region of the air inlet slots LS through the linearly arranged openings 13 for forming a fuel/air mixture.

LIST OF DESIGNATIONS

1 First burner shell section
2 Cone segment
3 Lateral surface
4 Trailing edge
5 Continuous line, turning point line
6, 7 Top and bottom side edge of the first burner shell section
8 Second burner shell section
9 Third burner shell section
10 Prismatic auxiliary body with quarter elliptical surface
11 Separating line
12 Leading edge
13 Opening

14 Fuel line
15 Supporting structure
16 Shaped element
B Burner shell
L Air flow
LS Air inlet slot While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A premix burner for producing an ignitable fuel/air mixture, comprising a support structure:

a swirl generator having at least two burner shells positioned circumferentially around the support structure to complement one another to form a throughflow body, each burner shell having a first burner shell section having a partial cone shape enclosing an axially conically widening swirl space and which mutually defines, in an axial cone longitudinal direction, tangential air inlet slots though which combustion feed air can pass into the swirl space and from which an axially spreading swirl flow can form, means for feeding fuel arranged at least in sections along the tangentially running air inlet slots, a second burner shell section curved in opposition to the first burner shell section and having a partial cone shape flush to said first burner shell section, and a third burner shell section adjoining the second burner shell section flush, said third burner shell section having a curvature tangentially continuous to the second burner shell section, the third burner shell section defining on one side one of the tangential air inlet slots an having a leading edge past which combustion feed air can flow, the third burner shell section curvature, merging continuously and smoothly into the curvature of the second burner shell section, and all locations of a change of curvature describing a turning point line;

wherein the means for feeding fuel is positioned along the turning point line;

wherein the second burner shell section directly extends from the first burner shell section, and the first, second, and third burner shell section form a continuous surface and wherein the swirl space is formed between circumferentially adjacent burner shells.

2. The premix burner as claimed in claim 1, wherein the third burner shell section is triangular.

3. The premix burner as claimed in claim 2, wherein the third burner shell section has a longest triangle side which is connected in one piece to the second burner shell section, the third burner shell section has a shortest triangle side which closely joins a shape element flush, said shaped element enclosing all the burner shells at the downstream end region of the swirl generator, and a third triangle side is provided which forms the leading edge.

4. The premix burner as claimed in claim 1, wherein each of the at least two burner shells comprises a metallic surface material which can be processed by bending

5. The premix burner as claimed in claim 1, wherein the second and third burner shell sections together form a convexly curved surface which faces the air inlet slot an merges continuously into a concave surface which faces the swirl space and is formed by the firs burner shell section.

6. The premix burner as claimed in claim 1, wherein the at least two burned shells comprises n burner shells enclosing the swirl space n>2, and each first burner shell section corresponds to one nth of a complete cone shell.

7. The premix burner as claimed in claim 1, wherein the second burner shell section closely joins a tangentially running surface line of the first burner shell section flush, an the third burner shell section closely joins a tangentially running edge contour

8. The premix burner as claimed in claim 1, wherein the second burner shell section has a curvature and a shape described by a quarter ellipse segment

9. The premix burner as claimed in claim 1, wherein the second burner shell segment has a curvature and a shape described by a quarter circle segment.

10. The premix burner as claimed in claim 1, wherein the shape of the first second, and third burner shell sections joined in one piece is described by a system of straight lines running in the longitudinal direction of the burner shell

11. The premix burner as claimed in claim 4, wherein the surface material is steel.

* * * * *